US009160096B2

(12) United States Patent
Morley

(10) Patent No.: US 9,160,096 B2
(45) Date of Patent: Oct. 13, 2015

(54) HIGH SPEED CONNECTOR

(71) Applicant: Tyco Electronics Corporation, Berwyn, PA (US)

(72) Inventor: Stephen T. Morley, Manheim, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 13 days.

(21) Appl. No.: 14/099,576

(22) Filed: Dec. 6, 2013

(65) Prior Publication Data

US 2015/0162696 A1 Jun. 11, 2015

(51) Int. Cl.
*H01R 13/514* (2006.01)

(52) U.S. Cl.
CPC ..... *H01R 13/514* (2013.01)

(58) Field of Classification Search
CPC ..... H01R 9/05; H01R 9/0503; H01R 9/0506; H01R 9/0509; H01R 9/0512; H01R 9/0515; H01R 9/0518; H01R 9/0521; H01R 9/0524; H01R 9/0527; H01R 24/40; H01R 24/42; H01R 24/44; H01R 24/46; H01R 24/48; H01R 24/52; H01R 24/54; H01R 24/542; H01R 24/56
See application file for complete search history.

(56) References Cited

U.S. PATENT DOCUMENTS

| | | | | |
|---|---|---|---|---|
| 6,309,251 | B1 * | 10/2001 | Tang | 439/584 |
| 7,972,173 | B1 | 7/2011 | Hyzin et al. | |
| 8,022,795 | B2 * | 9/2011 | Montena | 333/263 |
| 2012/0058672 | A1 | 3/2012 | Blasick et al. | |
| 2013/0157504 | A1 | 6/2013 | Sykes et al. | |

FOREIGN PATENT DOCUMENTS

| | | | |
|---|---|---|---|
| DE | 198 50 394 | A1 | 5/2000 |
| EP | 1 223 645 | A2 | 7/2002 |

OTHER PUBLICATIONS

International Search Report, International Application No. PCT/US2014/068128, International Filing Date, Dec. 2, 2014.

* cited by examiner

*Primary Examiner* — Ross Gushi

(57) ABSTRACT

A connector assembly includes a shell, an insulator held by the shell and a center contact held by the insulator. The center contact has a terminating segment. The connector assembly also includes a compound dielectric surrounding the terminating segment. The compound dielectric is positioned between the terminating segment and the shell. The compound dielectric includes a first dielectric layer that at least partially surrounds the center contact. The compound dielectric also includes a second dielectric layer at least partially surrounding the first dielectric layer. The second dielectric layer has a different dielectric constant than the dielectric constant of the first layer.

20 Claims, 8 Drawing Sheets

HIGH SPEED CONNECTOR

BACKGROUND

The subject matter herein relates generally to RF connectors.

Due to their favorable electrical characteristics, coaxial cables and connectors have grown in popularity for interconnecting electronic devices and peripheral systems. Typically, one connector is mounted to a circuit board of an electronic device at an input/output port of the device and extends through an exterior housing of the device for connection with a coaxial cable connector. The connectors include an inner conductor coaxially disposed within an outer conductor, with a dielectric material separating the inner and outer conductors.

A typical application utilizing coaxial cable connectors is a radio-frequency (RF) application having RF connectors designed to work at radio frequencies in the UHF, VHF, and/or microwave range. RF connectors are typically used with coaxial cables and are designed to maintain the shielding that the coaxial design offers. RF connectors are typically designed to minimize the change in transmission line impedance at the connection by utilizing contacts that have a short contact length. In most coaxial cable applications, it is preferable to match the impedance between the source and the destination electrical components located at opposite ends of the coaxial cable. When sections of coaxial cable are interconnected by connector assemblies, it is equably preferable that the impedance remain matched through the interconnection.

Conventional coaxial connectors include a matable interface. The interface may include a plug and a compatible receptacle. The matable plug has a variable length to allow compression along the axial direction of the matable plug. The matable plug compresses when mated with the receptacle. The matable plug typically has greater impedance when extended, and approaches optimal impedance when fully compressed.

Known RF connectors having variable length matable plugs are not without disadvantages. For instance, the matable plug may not be fully compressed, thus having a sub-optimal impedance. The sub-optimal impedance may impact electrical performance of the connector. The further the plug is from being fully compressed, the worse the electrical performance.

A need remains for a connector assembly with a matable plug that provides optimal impedance without being fully compressed. A need remains for a connector assembly that may be mated in a safe and reliable manner.

BRIEF DESCRIPTION

In an embodiment, a connector assembly is disclosed. The connector assembly includes a shell. The connector assembly also includes an insulator held by the shell. The insulator holds a center contact having a terminating segment. The connector assembly also includes a compound dielectric surrounding the terminating segment. The compound dielectric is positioned between the terminating segment and the shell. The compound dielectric includes a first dielectric layer that at least partially surrounds the center contact. The compound dielectric also includes a second dielectric layer at least partially surrounding the first dielectric layer. The second dielectric layer has a different dielectric constant than the dielectric constant of the first layer.

In an embodiment, a connector assembly includes a shell. The connector assembly also includes an insulator held by the shell. The insulator holds a center contact having a terminating segment. The mating contact is held by the shell for mating with the terminating segment to from an electrical connection through the connector assembly. The mating contact and the terminating segment slidably engage one another. The mating contact and the terminating segment have a mating range and a mating distance formed therebetween. The connector assembly also includes a compound dielectric surround the terminating segment. The compound dielectric is positioned between the terminating segment and the shell. The compound dielectric includes a first dielectric layer that at least partially surrounds the center contact and a second dielectric layer that at least partially surrounds the first dielectric layer. The second dielectric layer has a different dielectric constant than a dielectric constant of the first dielectric layer.

DETAILED DESCRIPTION

Figure 1:
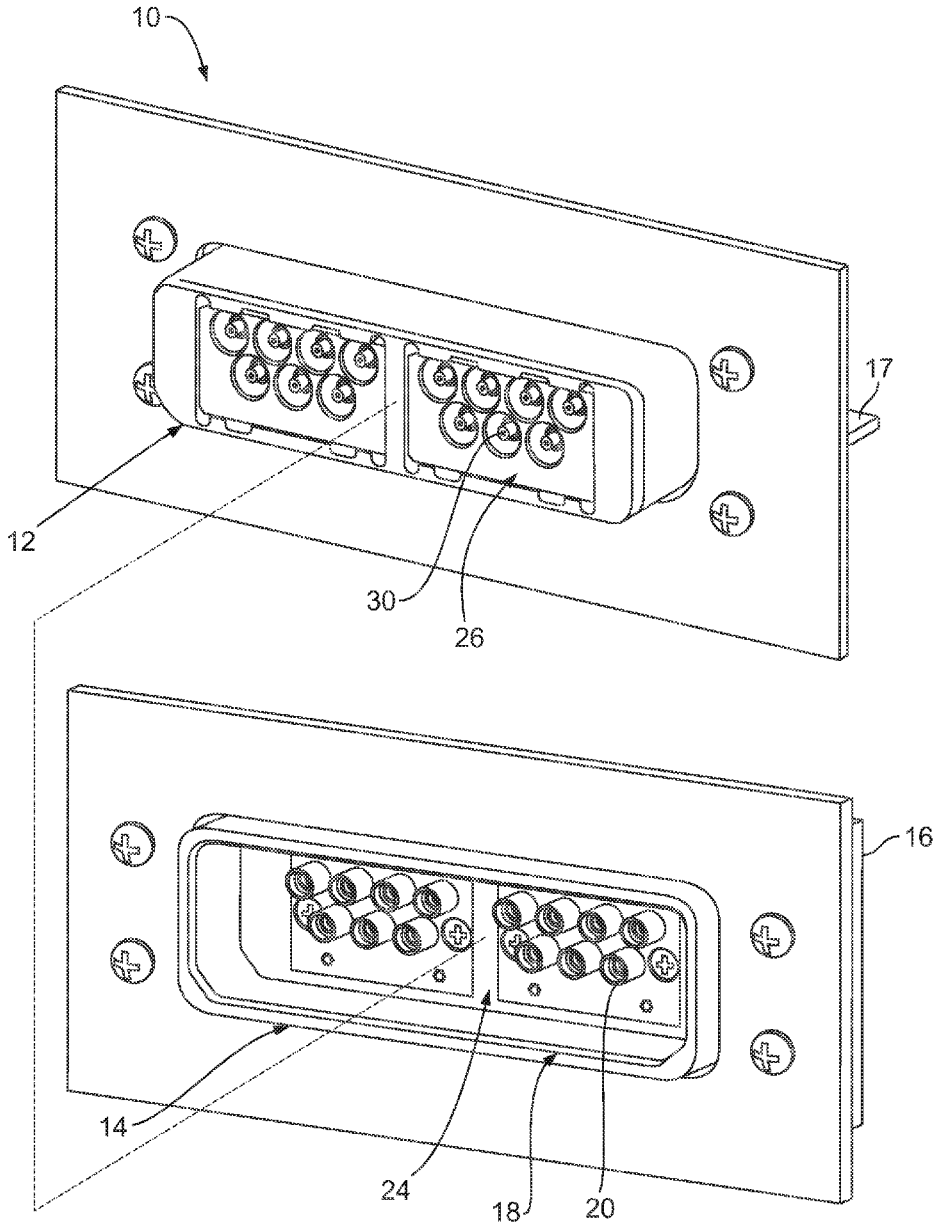
FIG. 1 illustrates an electrical connector system formed in accordance with an exemplary embodiment including an RF module and an electrical connector assembly.

FIG. 1 illustrates an electrical connector system 10 including an RF module 12 and an electrical connector assembly 14 formed in accordance with an exemplary embodiment. FIG. 1 shows front perspective views of both the RF module 12 and the electrical connector assembly 14, which are configured to be mated together along the phantom line shown in FIG. 1. In an exemplary embodiment, the electrical connector assembly 14 defines a motherboard assembly that is associated with a motherboard 16. The RF module 12 defines a daughtercard assembly that is associated with a daughtercard 17.

The electrical connector assembly 14 includes a housing 18 and a plurality of electrical connectors 20 held within the housing 18. Any number of electrical connectors 20 may be utilized depending on the particular application. In the illustrated embodiment, seven electrical connectors 20 are provided in two rows. The electrical connectors 20 are cable mounted to respective coaxial cables (not shown). Alternatively, the electrical connectors 20 may be terminated to the motherboard 16. The housing 18 includes a mating cavity 24 that defines a receptacle for receiving the RF module 12.

In an exemplary embodiment, the RF module 12 defines a plug that may be received within the mating cavity 24. The RF module 12 includes a housing 26 and a plurality of RF connectors 30 held within the housing 26. In an embodiment, the RF connectors 30 are cable mounted to respective coaxial cables (not shown). The RF module 12 and electrical connector assembly 14 are mated with one another such that the electrical connectors 20 mate with the RF connectors 30. In alternative embodiments, the RF module 12 and electrical connector assembly 14 are both board mounted, or alternatively, one of the RF module 12 and electrical connector assembly 14 are cable mounted, while the other is board mounted.

Figure 2:
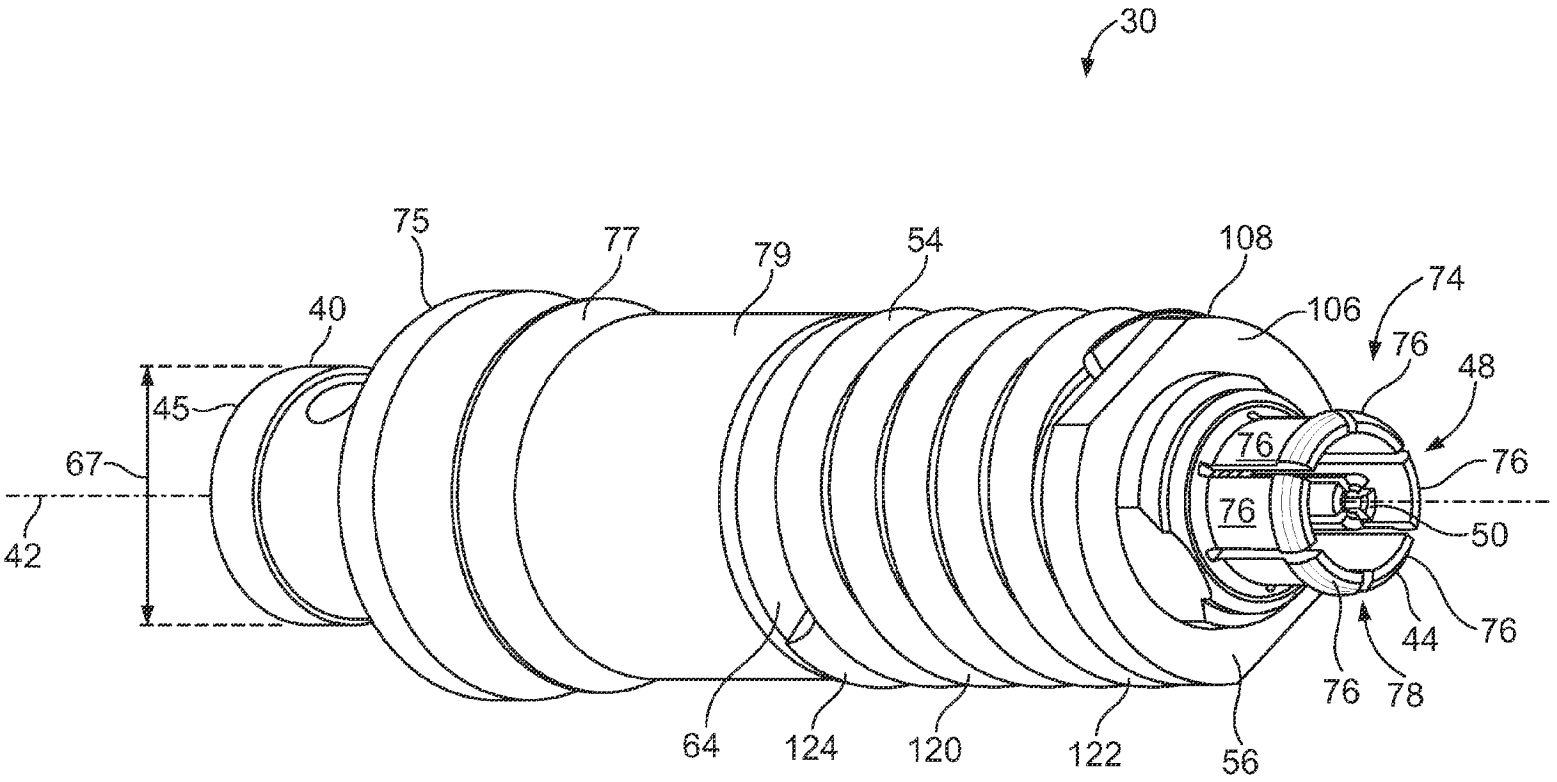
FIG. 2 is a perspective view of an RF connector in accordance with an exemplary embodiment for use with the system shown in FIG. 1.
Figure 4:
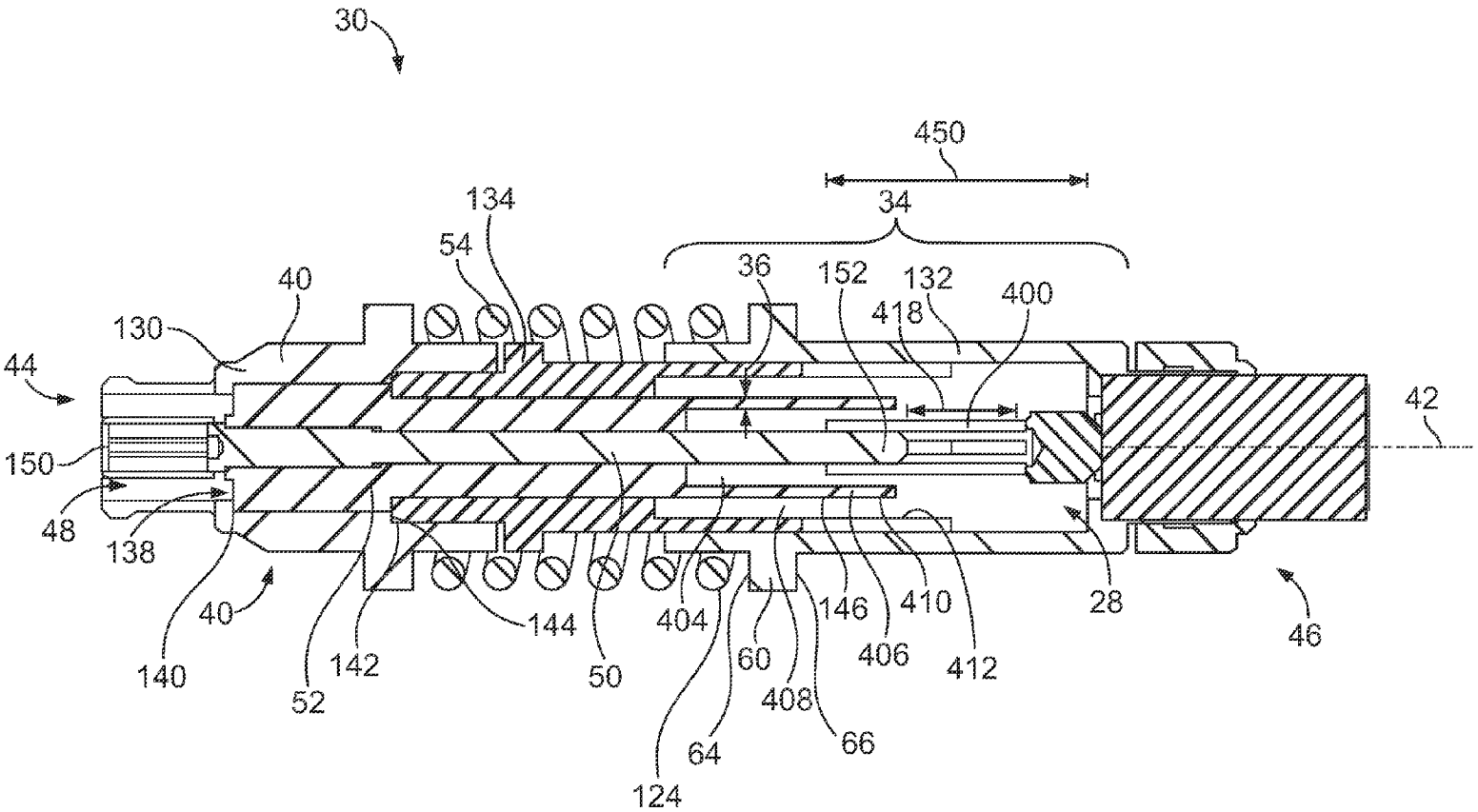
FIG. 4 is a cross-sectional view of an exemplary embodiment of an RF connector having a second flange.

FIG. 2 is a perspective view of one of the RF connectors 30 shown in FIG. 1. The RF connector 30 includes a shell 40 extending along a central longitudinal axis 42 between a mating end 44 and a mating end 45. When configured as such, the RF connector 30 is known as a jack-to-jack type connector or a "bullet" type connector. In an alternative embodiment, the mating end 45 may be configured as a cable end 46, as shown in FIG. 4. Further, the cable end 46 may be aligned with the central longitudinal axis 42. Alternatively, the cable end 46 may be perpendicular to the central longitudinal axis 42. When configured as such, the RF connector is known as a right angle type connector, as is discussed in relation to FIG. 8.

In various embodiments, the RF connector 30 includes a retaining ring 77, an outer shell 79, and a spring 54 coaxially located along the central longitudinal axis 42 and covering a portion of the shell 40. The shell 40 defines a shell cavity 48. The RF connector 30 includes a center contact 50 held within the shell cavity 48. In an exemplary embodiment, an insulator 52 (shown in FIG. 3) and a compound dielectric 34 (shown in FIG. 3) are positioned between the shell 40 and the center contact 50. In an exemplary embodiment, the shell 40 is formed from a conductive material, such as a metal material, and the insulator 52 and the compound dielectric 34 electrically separate the center contact 50 and the shell 40.

The shell 40 is cylindrical in shape. The shell 40 is tapered or stepped at the mating end 44 such that a shell diameter 67 at the mating end 44 is smaller than along other portions of the shell 40. The shell 40 includes a tip portion 74 and a rear facing surface 75. When the RF connector 30 is mated with the electrical connector 20 (shown in FIG. 1), the tip portion 74 is received within the electrical connector 20 and the rear facing surface 75 engages the housing 26. In an exemplary embodiment, the tip portion 74 includes a plurality of segments 76 that are separated by gaps 78. The segments 76 are movable with respect to one another such that the segments 76 may be deflected toward one another to reduce the diameter of the tip portion 74 for mating with the electrical connector 20. Deflection of the segments 76 may cause a friction fit with the electrical connector 20 when mated.

The spring 54 concentrically surrounding a portion of the shell 40. The RF connector 30 includes a retaining flange 56 used to retain the spring 54 in position with respect to the shell 40. The retaining flange 56 includes a forward facing surface 106 and a rear engagement surface 108. The spring 54 has a helically wound body 120 extending between a front end 122 and a rear end 124. The rear end 124 faces a forward facing surface 64 of the outer shell 79. The spring 54 has a spring diameter that is greater than the shell diameter 67. The spring 54 is compressible axially.

The retaining flange 56 and the forward facing surface 64 of the outer shell 79 holds the spring 54 in position relative to the shell 40. The rear engagement surface 108 of the retaining flange 56 engages the front end 122 of the spring 54. Optionally, the retaining flange 56 may at least partially compress the spring 54 such that the spring is biased against the retaining flange 56.

Figure 3:
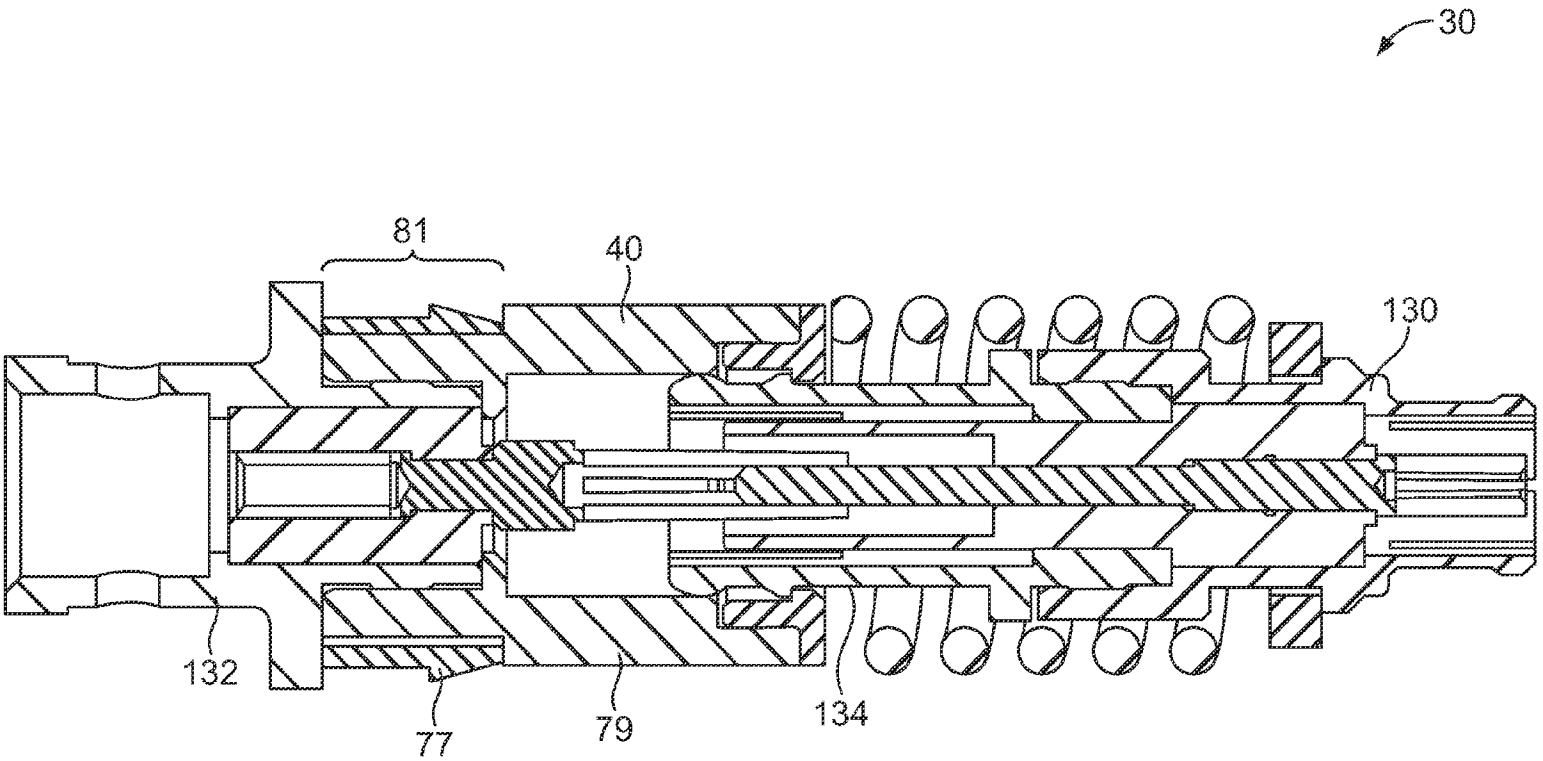
FIG. 3 is a cross-sectional view of the RF connector shown in FIG. 2 in an extended state.

FIG. 3 is a cross-sectional view of the RF connector 30 in an extended state. In the illustrated embodiment, the shell 40 includes a front shell 130, and outer shell 79, and a rear shell 132. Optionally, the shell 40 includes a mid-shell 134. The mid-shell 134 is received partially in the front shell 130 and extends into the outer shell 79. The retaining ring 77 surrounds a depressed portion 81 of the outer shell 79. The retaining ring 77 includes a partial arrowhead shaped end to allow the retaining ring to engage a complementary retaining portion 215 in the housing 26, as is discussed below. Optionally, the retaining ring 77 may be primed in tension to allow the retaining ring to compress radially inward to disengage the retaining ring 77 from the retaining portion 215. Although a retaining ring 77 is described herein, any fastener may be used to secure the outer shell 79 to the housing 26. For example, the outer shell 79 and the housing 26 may include complementary threaded portions. As another example, the outer shell 79 may be sized to provide a fiction fit with the housing 26.

FIG. 4 is a cross-sectional view of an exemplary embodiment of the RF connector 30 having a second flange 60. When configured with a second flange 60, the shell 40 may not include the outer shell 79 and the retaining ring 77. The rear shell 132 may be elongated generally from the cable end 46 to the mid-shell 134. The mid-shell 132 is partially received in the front shell 130 and extends into the rear shell 132.

The flange 60 extends radially outward from the shell 40. The flange 60 is positioned proximate the cable end 46. The flange 60 is positioned a distance from the mating end 44. The flange 60 includes a forward facing surface 64 and a rear facing surface 66. The surfaces 64, 66 are generally perpendicular with respect to the longitudinal axis 42. The rear end 124 faces the forward facing surface 64 of the flange 60. In the illustrated embodiment, the spring 54 is maintained between the flange 56 and the flange 60 such that the rear portion of the spring 54 abuts the forward facing surface 64.

The insulator 52 is held within the shell cavity 48 by the shell 40. For example, the front end 138 of the insulator 52 engages a lip 140 of the front shell 130 proximate to the mating end 44. A center edge 142 of the insulator 52 engages a front surface 144 of the mid-shell 134. Thus, the insulator 52 is held in the front shell 130 and/or the mid-shell 134. In an exemplary embodiment, the insulator 52 includes an extension 146 at a rear thereof surrounding a portion of the center contact 50. The extension 146 may be integral with the insulator 52. Alternatively, the extension 146 may be discrete and coupled to the insulator 52.

The center contact 50 is held within the shell cavity 48 by the insulator 52. The center contact 50 includes a mating end 150 diametrically opposed to a terminating segment 152. The terminating segment 152 is exposed to a cavity 28. The mating end 150 is configured to mate with a center contact 154 (shown in FIG. 8) of the electrical connector 20. The mating end 150 is positioned proximate to the mating end 44 of the shell 40. The terminating segment 152 mates with a mating contact 400. The mating contact 400 is electrically terminated to a cable, such as, to a center conductor (not shown) of a coaxial cable. The rear shell 132 is configured to mechanically and/or electrically connect to the cable, such as, to a cable braid, a cable insulator and/or a cable jacket.

Alternatively, in an embodiment having jack-to-jack type connectors, the mating contact 400 is electrically terminated to another mating end such as the mating end 44. For example, in an embodiment, the RF module 12 may include a plurality of connectors 20. The connector assembly 14 may include a plurality of connectors 20. A plurality of RF connectors 30 may then mate with the connectors 20 of the RF module 12 and the connectors 20 of the connector assembly 14 to provide an electrical connection between the RF module 12 and the connector assembly 14.

Alternatively, or optionally, the jack-to-jack type connectors may include a right angle type plug. In a right angle type plug, the mating contact electrically terminates to a mating end such as the mating end 44. In a right angle type plug, the mating end 44 shell cavity 48 in the mating end 44 faces radially outward from the longitudinal axis 42. In other words, the mating end 44 opens at a right angle relative to the longitudinal axis 42. Alternatively, the mating contact 400 electrically terminates to a circuit board, such as, for example, the motherboard 16.

The rear shell 132 holds the compound dielectric 34. The compound dielectric 34 surrounds the terminating segment 152. The compound dielectric 34 is positioned between the terminating segment 152 and the shell 40. The compound dielectric 34 includes a first dielectric layer 404, a second dielectric layer 406, and a third dielectric layer 408. The dielectric layers 404, 406, and 408 may comprise any dielectric material type including, but not limited to, air, plastic, rubber, glass, paper, paraffin, Polytetrafluoroethylene (PTFE), polyethylene, polystyrene, and/or the like. The dielectric constant of the second dielectric layer 406 is different from the dielectric constant of at least one of the second dielectric layer 406 or the third dielectric layer 408, as described below.

The first dielectric layer 404 at least partially surrounds the center contact 50. In other words, the first dielectric layer 404 is concentrically wrapped around the center contact 50. The first dielectric layer 404 extends along the longitudinal axis 42. In the illustrated embodiment, the first dielectric layer 404 is defined by a gap between the extension 146 and the center contact 50 that is filled with air.

The second dielectric layer 406 at least partially surrounds the first dielectric layer 404. In other words, the second dielectric layer 406 is concentrically wrapped around the first dielectric layer 404. The second dielectric layer 406 is defined by the extension 146 and extends along the longitudinal axis 42. Optionally, the second dielectric layer 406 may be integrally formed with the insulator 52. As an extension of the insulator 52, the second dielectric layer 406 extends along the longitudinal axis 42 into the rear shell 132. The second dielectric layer 406 has a layer thickness 36.

The third dielectric layer 408 at least partially surrounds the second dielectric layer 406. In other words, the third dielectric layer 408 is concentrically wrapped around the second dielectric layer 406. The third dielectric layer 408 extends along the longitudinal axis 42. In the illustrated embodiment, the third dielectric layer 408 is defined by a gap between the outer surface 410 of the second dielectric body 406 and the inner surface 412 of the front shell 132.

The dielectric constant of the first dielectric layer 404 is different from the dielectric constant of the second dielectric layer 406. For example, the second dielectric layer 406 may have a dielectric constant greater than the dielectric constant of the first dielectric layer 404. For example, the first dielectric layer 404 and the third dielectric layer 408 may comprise air having a dielectric constant of 1.0. The second dielectric layer 406 may comprise Teflon have a dielectric constant of 2.1. The average or compound dielectric constant of the compound dielectric layer 34 may be based on the layer thickness 36, and the thickness of the first and third dielectric layers 404, 408, such that increasing the layer thickness 36 reduces the thickness of the first dielectric layer 404 and/or the third dielectric layer 408, which increases the compound dielectric constant of the compound dielectric 34.

The front shell 130 is axially aligned with the rear shell 132 forward of the rear shell 132 along the longitudinal axis 42. The mid-shell 134 spans across the front and rear shells 130,132. The rear shell 132 may receive at least part of the front shell 130. The front shell 130 is movable along the longitudinal axis 42, while, as described above, the rear shell may be secured to the housing 26. For example, the front shell 130 may be compressible against the spring 54. As the front shell 132 moves toward the cable end 46, the forward facing surface 64 abuts the spring 54 to cause the spring 54 to compress. As shown in the illustrated embodiment, the RF connector 30 is in the extended state. In the extended state, the spring 54 has a pre-load compression.

Figure 5:
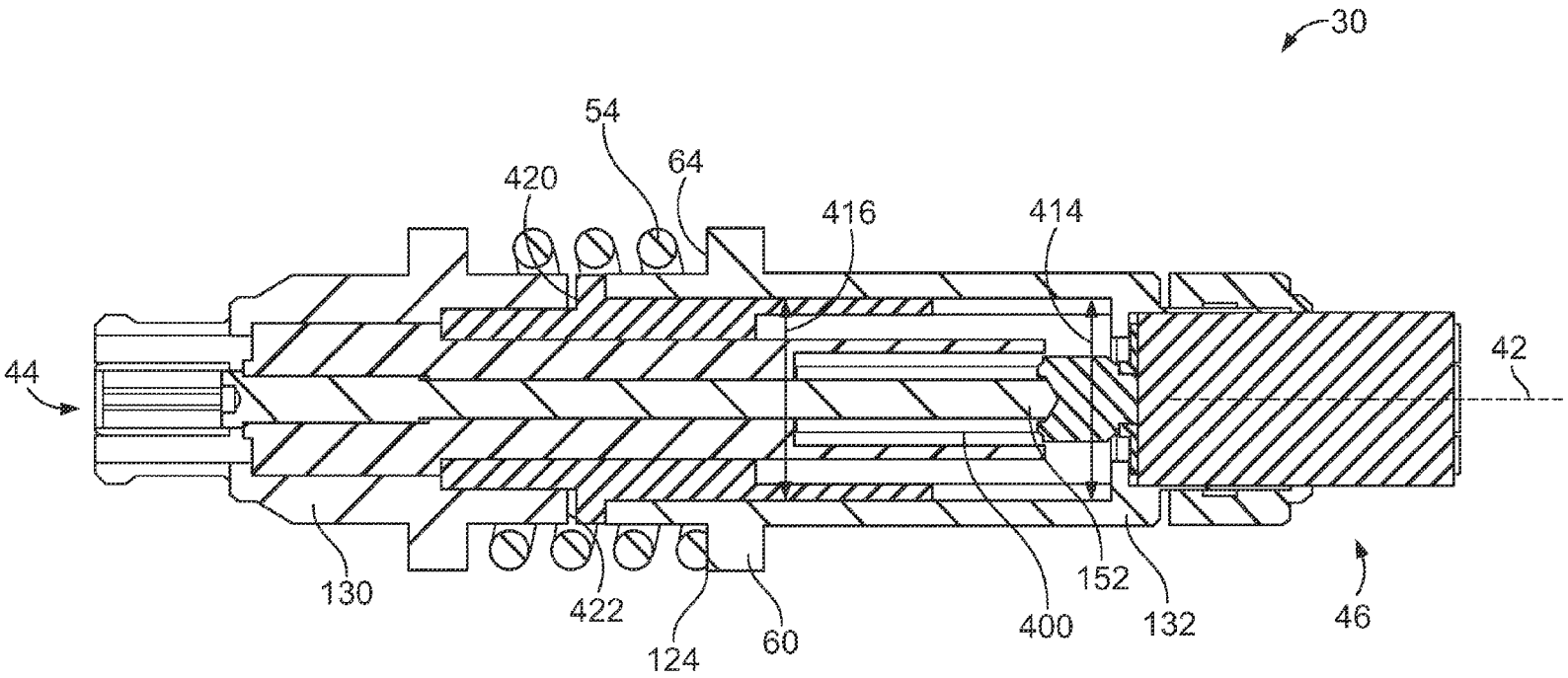
FIG. 5 is a cross-sectional view of the RF connector shown in FIG. 4 in a compressed state.

FIG. 5 is a cross-sectional view of the RF connector 30 shown in FIG. 4 in a compressed state. To enter the compressed state, the rear shell 132 may move axially toward the mating end 44 and/or the front shell 130 may move axially toward the rear shell 132. As the rear shell 132 moves, the forward facing surface 64 contacts the rear end 124 of the spring 54 to cause the spring 54 to compress. The rear shell 132 moves toward the mating end 44 until the forward facing surface 420 of the rear shell 132 abuts the rear facing surface 422 of the front shell 130.

The rear shell 132 has an inner diameter 414 that fits in close tolerance with the an outer diameter 416 of the mid-shell 134 (or the front shell 130 in the case where the structure of the mid-shell 134 is part of the front shell 130), such that the rear shell 132 limits angular movement of the front shell 130 relative to the longitudinal axis 42. Limiting angular movement of the rear shell 132 helps encourage the terminating segment 152 to mate with the mating contact 400 as the rear shell 132 travels axially along the longitudinal axis 42.

The terminating segment 152 slidably mates with the mating contact 400. The terminating segment 152 and the mating contact 400 have a range of motion defined by a mating range 450 (shown in FIG. 3). In other words, the terminating segment 152 is allowed to travel the length of the mating range 450 along the longitudinal axis 42. For example, the mating range 450 may be approximately 3.0 mm. The mating range 450 may be longer or shorter in alternative embodiments. The terminating segment 152 remains in electrical and mechanical contact with the mating contact 400 throughout the mating range 450.

When mated, the terminating segment 152 is plugged into the mating contact 400 to an initial or retracted position (FIG. 4). From the initial or retracted position, the terminating segment 152 may be further plugged into the mating contact 400 to a final or advanced position (FIG. 5) as the RF connector 30 is moved from the extended state to the compressed state. A mating distance 418 is defined as the distance or amount of movement of the terminating segment 152 from the position of the terminating segment to the advanced position. A maximum mating distance 418 is defined between the retracted position (FIG. 4) and the advanced position (FIG. 5). The maximum mating distance 418 may be less than the mating range 450. In the extended state (FIG. 4), the mating distance 418 has the greatest value. In the compressed state (FIG. 5), the mating distance approaches a nominal value. For example, the mating distance 418 may be approximately 0.0 mm when the RF connector 30 is in the extended state. Electrical characteristics of the RF connector 30, such as inductive, capacitive, and impedance characteristics, may vary depending on the mating distance 418 (e.g. depending on the position of the terminating segment relative to the mating contact 400).

Figure 6:
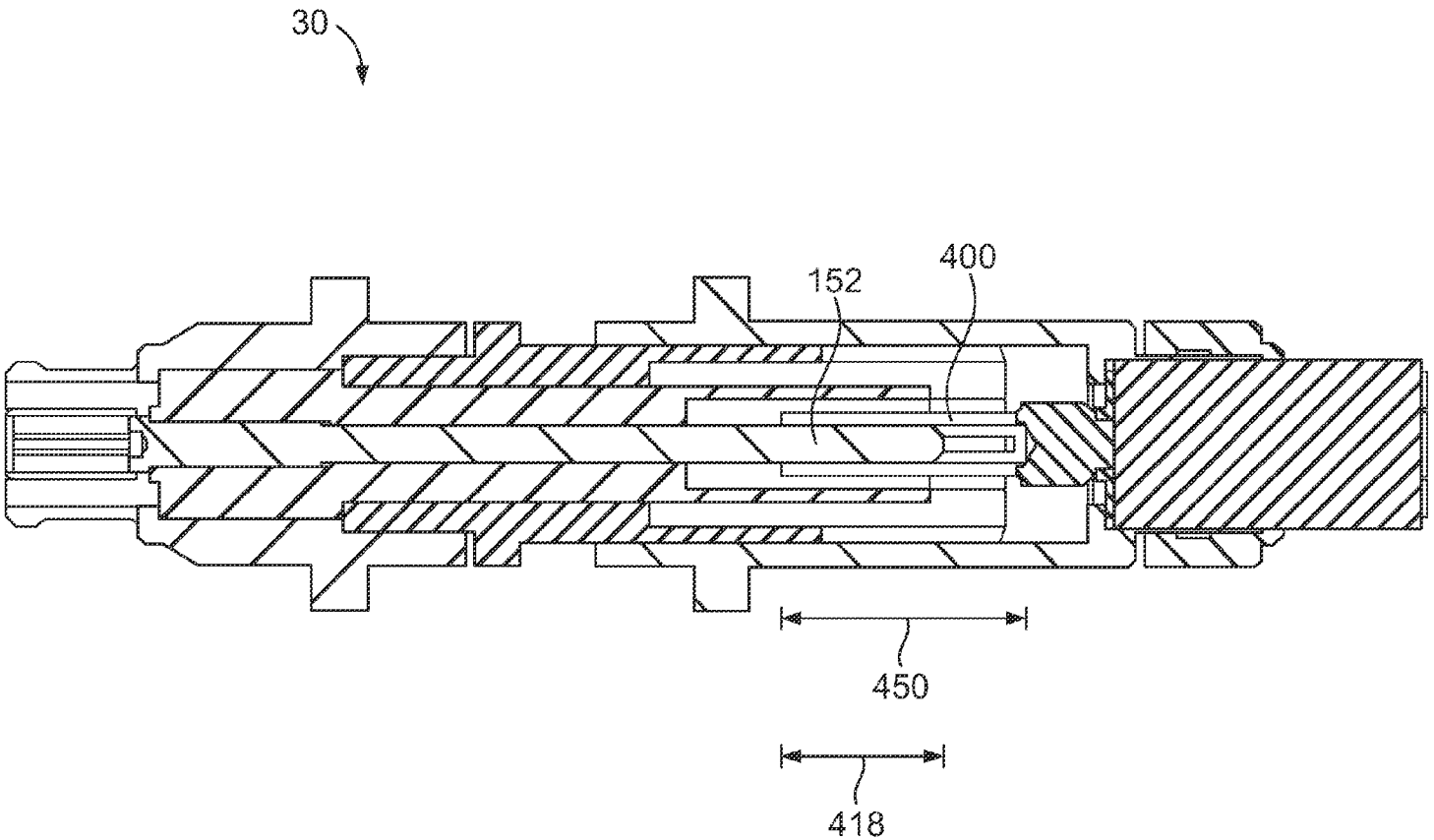
FIG. 6 is a cross-sectional view of the RF connector shown in FIG. 4 in an intermediate state.

FIG. 6 is a cross-sectional view of the RF connector 30 shown in FIG. 4 in an intermediate state. In the intermediate state, the RF connector 30 is partially compressed. The terminating segment 152 is pressed into the mating contact 400 part of the way between the retracted position (FIG. 4) and the advanced position (FIG. 5). In the intermediate state, the mating distance 418 may be in an intermediate zone. For example, the intermediate zone may range from 25 percent to 75 percent of the mating range 450 or of the maximum mating distance 418. The intermediate zone may include the midpoint of the mating range 450.

The RF connector 30 may carry a RF signal in the VHF, UHF, or microwave range. The RF connector 30 has electrical characteristics such as inductive, capacitive, and impedance characteristics. The electrical characteristics vary as the terminating segment 152 advances into, and is received by the mating contact 400. In other words, the impedance, capacitance, and inductance of the RF connector 30 change as the mating distance 418 changes. The impedance of the RF connector 30 is based on the relative positions of the terminating segment 152 and the mating contact 400. It is desirable to match the impedance of the RF connector 30 to an external load to maintain useful performance of the RF connector 30. For example, impedance matching the RF connector 30 to the external load improves power transmission, reduces reflections in the signal, and the like.

Conventional RF connectors have designed the RF connector 30 to match the ideal impedance (e.g., the impedance value approximately matching the external load) at the fully compressed state. However, in use, the RF connector 30 is unlikely to be fully compressed, but rather is more likely to be only partially compressed. Therefore, the actual impedance experienced at many partially compressed stages (e.g. any state other than the fully compressed state) is sub-optimal, causing decreased performance. In an exemplary embodiment, the RF connector 30 is designed to achieve optimal impedance (or other characteristics) when the mating distance 418 is in the intermediate zone. For example, the ideal impedance may be 50 ohms. Providing the ideal impedance in the intermediate zone, as opposed to designing the RF connector 30 to operate at the ideal performance in the fully compressed state, allows for increased performance of the RF connector 30 because the mating distance 418 is most likely in the intermediate zone when the RF connector 30 is mounted to the coaxial cables. In other words, when the RF module 12 and the electrical connector assembly 14 are mated with one another, certain electrical connectors 20 may not fully mate with their corresponding RF connectors 30 (e.g., the RF connector 30 is likely in a partially compressed state rather than a fully compressed state). Thus, designing the RF connector 30 to the ideal impedance at either the extended or compressed state may provide sub-optimal performance, because, in use, the RF connector 30 is only partially compressed.

In an exemplary embodiment, the RF connector 30 is designed to achieve the predetermined impedance at an intermediate mating distance 418 in the intermediate zone, such as at or near the midpoint of the maximum mating distance 418. The compound dielectric 34 is designed to achieve a target impedance, such as 50 Ohms, at the selected intermediate or target mating distance 418, such as at 1.0 mm. By controlling the thicknesses of the layers of the compound dielectric 34, the material of the layers of the compound dielectric 34, and thus the dielectric constants of the layers of the compound dielectric 34, the impedance may be tuned to the target impedance.

Figure 7:
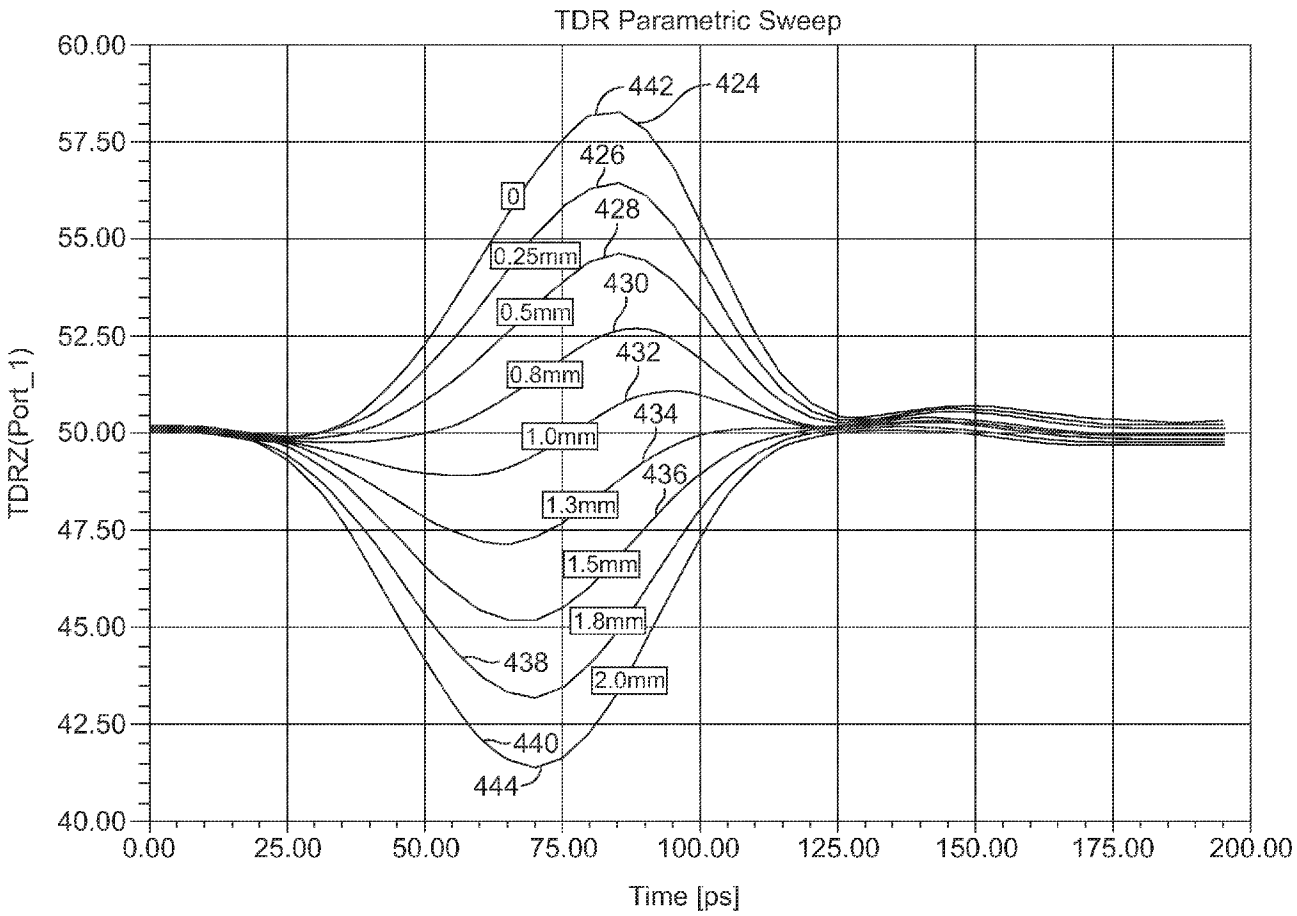
FIG. 7 is a plot showing impedances traces of several signals having various mating distances.

FIG. 7 is a plot showing impedances traces of several signals at various mating distances. The impedance curves 424, 426, 428, 430, 432, 434, 436, 438, and 440 represent the impedance of the RF connector 30 of different mating distances 418. The impedance curve 424 represents the impedance when the RF connector 30 is in the compressed state. In other words, the impedance curve 424 represents the impedance when the mating distance 418 has a nominal value (e.g., 0 mm). The increased impedance of the impedance curve 424 at the peak 442 is indicative of a greater inductive component. A greater inductive component may imply energy dissipation and may result in reduced efficiency of the RF connector 30. The impedance curve 440 represents the impedance of RF connector 30 in the extended state. For example, the impedance curve 440 represents the impedance when the mating distance 418 is 2.0 mm. The reduced impedance indicated by the impedance curve 440 at the valley 44 is indicative of a greater capacitive component. Similar to the inductive component, an elevated capacitive component may result in energy dissipation and may result in reduced efficiency of the RF connector 30. The impedance curve 432 represents the impedance of a mating distance 418 approximately at the midpoint, such as at 1.0 mm. The RF connector 30 maintains an impedance of 50 ohms near the midpoint.

Figure 8:
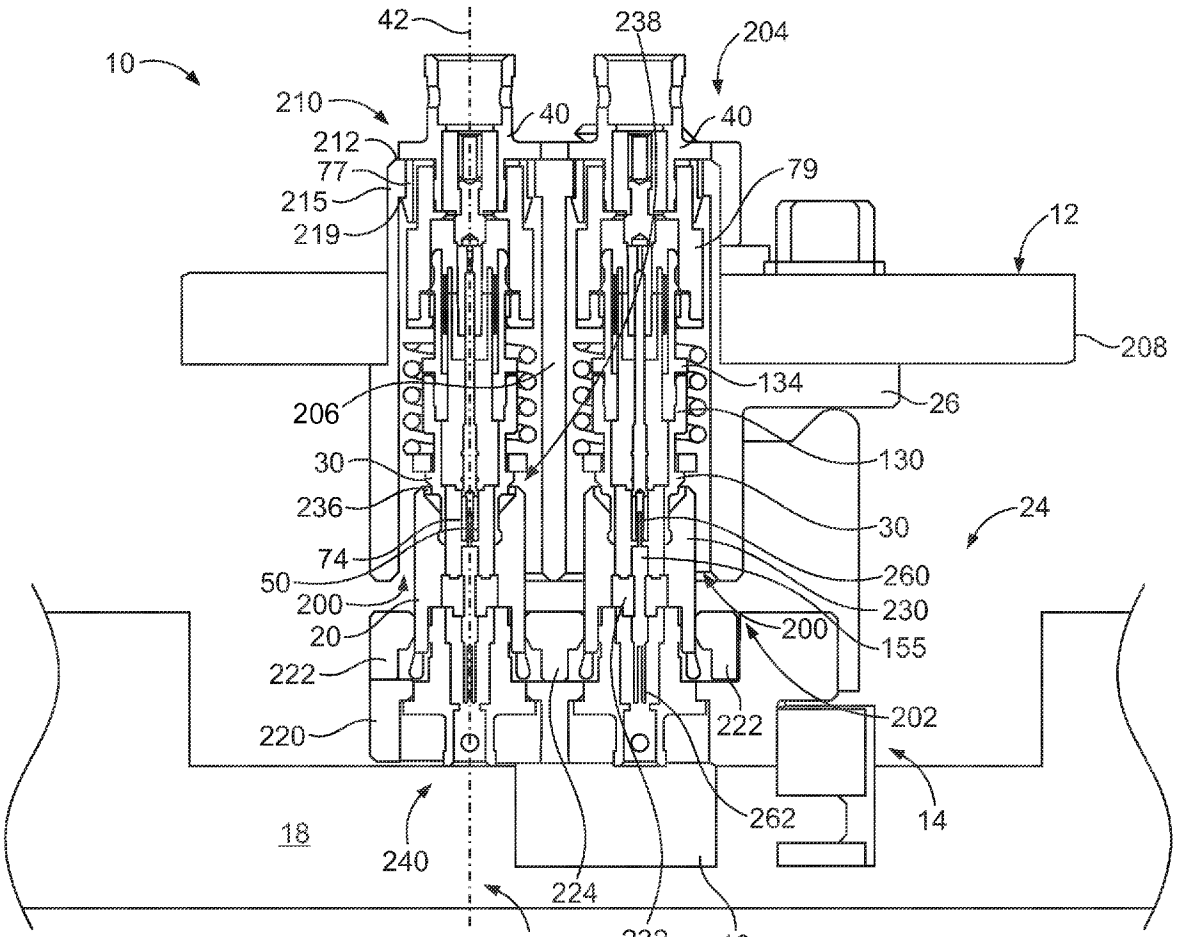
FIG. 8 is a partial cross-sectional view of an exemplary embodiment of the electrical connector system shown in FIG. 1 illustrating the RF module and the electrical connector assembly in a mated position.

FIG. 8 is a partial cross-sectional view of an electrical connector system 10 illustrating the RF module 12 and the electrical connector assembly 14 in a mated position. The RF module 12 includes the housing 26 and a plurality of the RF connectors 30. The housing 26 includes a plurality of walls defining connector cavities 200. The housing 26 extends between a mating end 202 and a rear wall 204 on a back side of the housing 26. Some of the walls define interior walls 206 that separate adjacent connector cavities. Optionally, the connector cavities 200 may be cylindrical in shape. In the illustrated embodiment, the housing 26 is received in a chassis 208 that is part of a daughtercard assembly. Optionally, a plurality of RF modules 12 may be coupled to the chassis 208. The RF modules 12 may be identical to one another, or alternatively, different types of RF modules or other types of modules may be held in the chassis 208.

The rear wall 204 includes a plurality of openings 210 therethrough that provide access to the connector cavities 200. The RF connectors 30 extend through the openings 210 into the connector cavities 200. In an exemplary embodiment, a portion of the shell 40 is positioned outside of the housing 26 (e.g. rearward or behind the rear wall 204), and a portion of the shell 40 is positioned inside the connector cavity 200. The rear wall 204 includes first and second sides 212, 214, respectively, with the first side 212 facing rearward and outside of the housing 26 and the second side 214 facing forward and into the connector cavity 200. The housing 26 includes a retaining portion 215 between the first and second sides 212, 214. The retaining portion 215 engages the retaining ring 77 such that motion of the outer shell 79 along the longitudinal axis 42 is substantially reduced. Optionally, in various embodiments, the spring 54 engages the second side 214 of the rear wall 204. In an exemplary embodiment, the spring 54 is biased against the rear wall 204 to position the RF connector 30 relative to the rear wall 204.

The electrical connector assembly 14 includes the housing 18 and a plurality of the electrical connectors 20. The housing 18 and electrical connectors 20 are mounted to the motherboard 16. The electrical connectors 20 extend through an opening in the motherboard 16 and are connected to the coaxial cables (not shown). The housing 18 includes a main housing 220 having walls defining the mating cavity 24. The main housing 220 is coupled to the motherboard 16, such as, for example, by using fasteners (not shown).

The housing 18 includes an insert 222 and an organizer 224 separate from, and coupled to, the insert 222. The electrical connectors 20 are held by the insert 222 and organizer 224 as a subassembly, which is coupled to the main housing 220. For example, the subassembly may be positioned in an opening on the main housing 220 and secured to the main housing 220 using fasteners (not shown). The electrical connectors 20 extend from the organizer 224 at least partially into the mating cavity 24.

Each electrical connector 20 includes a shell 230, a dielectric body 232 received in the shell 230 and one of the contacts 154 held by the dielectric body 232. The dielectric body 232 electrically isolates the contact 154 from the shell 230. The shell 230 includes a mating end 236 having an opening 238 that receives the RF connector 30 during mating. The shell 230 includes a terminating end 240 that is terminated to a coaxial cable (not shown). The electrical connector 20 extends along a longitudinal axis 242. During mating, the longitudinal axis 42 of each RF connector 30 is generally aligned with the longitudinal axis 42 of the corresponding electrical connector 20.

The contact 154 includes a mating end 260 and a mounting end 262 that is terminated to a center conductor of the coaxial cable. Alternatively, the mounting end 262 may be terminated to the motherboard 16 using press-fit pins, such as an eye-of-the-needle pin. The mounting end 262 is securely coupled to the insert 222. The mating end 260 is securely held by the organizer 224. The mating end 260 extends beyond the organizer 224 for mating with the RF connector 30.

As the RF module 12 is mated with the electrical connector assembly 14, the RF connector 30 mates with the electrical connector 20. In the mated position, the tip portion 74 of the RF connector 30 is received in the opening 238 of the electrical connector 20. Optionally, the segments 76 (shown in FIG. 2) of the tip portion 74 may be flexed inward to fit within the opening 238. The tip portion 74 may be resiliently held within the opening 238. In the mated position, the contact 50 engages, and electrically connects to, the contact 154. In an exemplary embodiment, the shell 40 engages, and electrically connects to, the shell 230.

During mating, the spring 54 allows the RF connector 30 to float within the connector cavity 200 such that the RF connector 30 is capable of being repositioned with respect to the housing 26. Such floating or repositioning allows for proper mating of the RF connector 30 with the electrical connector 20. For example, the spring 54 may be compressed such that the relative position of the mating end 44 with respect to the rear wall 204 changes as the RF connector 30 is mated with the electrical connector 20. Because the position of the outer shell 79 is fixed by the retaining ring 77 to the housing 26, the front shell 130 and the mid-shell 134 move causing the terminating segment 152 to be received further into the mating contact 400, thus decreasing the mating distance 418. The organizer 224 holds the lateral position of the electrical connector 20 to keep the electrical connector 20 in position for mating with the RF connector 30. The organizer 224 resists tilting or rotating of the electrical connector 20 and keeps the electrical connector 20 extending along the longitudinal axis 242. Because the rear end 124 does not move, the cables are able to be fixed relative to the chassis 208.

In an exemplary embodiment, the spring 54 may compress or flex to allow the RF connector 30 to reposition axially along the longitudinal axis 42 in a longitudinal direction, shown in FIG. 2. A distance between the mating end 44 and the rear wall 204 may be shortened when the RF connector 30 is mated with the electrical connector 20. For example, when the tip portion 74 engages the electrical connector 20, the spring 54 may be compressed and the RF connector 30 may be recessed within the connector cavity 200. When the spring 54 is compressed, the spring 54 exerts a relatively higher biasing force against the flange 56 than when the spring 54 is not compressed, or when the spring 54 is less compressed. The biasing force is applied in a biasing direction, which may be generally along the longitudinal axis 42 toward the electrical connector 20. The spring 54 may maintain a reliable connection between the contact 50 and the mating contact 154 by forcing the RF connector 30 generally toward the electrical connector 20.

In addition to, or alternatively to, the axial repositioning of the RF connector 30, the RF connector 30 may be repositioned in a direction transverse to the longitudinal axis 42. For example, the RF connector 30 may be moved in a radial direction generally perpendicular with respect to the longitudinal axis 42. In this example, the RF connector 30 may be embodied as a right angle type connector. Optionally, the opening 210 in the rear wall 204 may have a larger diameter than the shell diameter 67 such that the shell 40 is movable within the opening in a non-axial direction (for example, in a direction generally toward a portion of the opening 210). In an exemplary embodiment, in addition to, or alternatively to, the radial repositioning of the RF connector 30, the RF connector 30 may be repositioned by pivoting the RF connector 30 such that the longitudinal axis 42 is non-parallel to the central axis of the connector cavity 200. Such radial repositioning and/or pivoting may allow the RF connector 30 to align with the electrical connector 20 during mating. The organizer 224 rigidly holds the electrical connector 20 in position with respect to the main housing 220, generally parallel to the central axis of the connector cavities 200. The organizer 224 resists tilting and/or floating of the electrical connector 20.

In an exemplary embodiment, the RF connector 30 may float within the connector cavity 200 in at least two non-parallel directions. For example, the RF connector 30 may float in an axial direction, also known as a Z direction. The RF connector 30 may float in a first lateral direction and/or a second lateral direction, such as in directions commonly referred to as X and/or Y directions, which are perpendicular to the Z direction. The RF connector 30 may float in any combination of the X-Y-Z directions. The RF connector 30 may be pivoted, such that the mating end 44 is shifted in at least one of the lateral directions X and/or Y. The floating of the RF connector 30 may properly align the RF connector 30 with respect to the electrical connector 20. Optionally, the floating may be caused by engagement of the RF connector 30 with the electrical connector 20 during mating.

An exemplary embodiment of the RF module 12 is thus provided that may provide a variable impedance based on the mating distance 418. The RF module 12 may be mated with the electrical connector assembly 14. The RF connector is received in the connector cavity 200 to mate with the electrical connector 20. The RF connector 30 has front shell 130 that includes the insulator 52 and a rear shell 132 that includes the compound dielectric 34. The insulator 52 holds the center contact 50. The compound dielectric 34 includes the first dielectric layer 404 and the second dielectric layer 406. The rear shell 132 also includes the terminating segment 152, which may be at various mating distances relative to the mating contact 400 as the RF connector 30 extends or retracts. The impedance of the RF connector 30 may be based on the mating distance 418. The compound dielectric 34 may be optimized to a particular mating distance 418, such as near the midpoint, to provide a load matched impedance. Controlling the thickness, types of dielectrics, and air gaps surrounding the center contact 50 allow control of impedance for matching or tuning the design based on the mating distance 418.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly, comprising:

a shell;

an insulator held by the shell;

a center contact held by the insulator, the center contact having a terminating segment at an end thereof;

a mating contact held in the shell for mating with the terminating segment to form a center conductor through the connector assembly, the mating contact and the terminating segment slidably engage one another as the connector assembly is compressed during mating with a mating connector, the mating contact and the terminating segment having a variable mating range defined between a retracted position and an advanced position with an intermediate position between the retracted position and the advanced position; and a compound dielectric surrounding the at least a portion of the center conductor, the compound dielectric positioned between the center conductor and the shell, the compound dielectric comprising, a first dielectric layer at least partially surrounding the center conductor; and a second dielectric layer at least partially surrounding the first dielectric layer;

wherein the second dielectric layer has a different dielectric constant than a dielectric constant of the first layer; and wherein the compound dielectric is impedance matched with the shell and center conductor at the intermediate position as opposed to at the retracted position or at the advanced position.

2. The connector assembly of claim 1, wherein the compound dielectric has a compound dielectric constant defined as an average dielectric constant of each of the layers of the compound dielectric between the shell and the terminating segment of the center contact.

3. The connector assembly of claim 2, wherein the compound dielectric constant is based on a thickness of the second dielectric layer.

4. The connector assembly of claim 1, the compound dielectric further including a third dielectric layer at least partially surrounding the second dielectric layer, the third dielectric layer having a dielectric constant different than the dielectric constant of the second dielectric layer.

5. The connector assembly of claim 4, wherein the first dielectric layer and the third dielectric layer comprises air.

6. The connector assembly of claim 1, wherein the second dielectric layer comprises a plastic material.

7. The connector assembly of claim 1, wherein the mating contact and the terminating segment having a mating distance between the retracted position and the advanced position, the intermediate position being approximately half way along the mating distance between the refracted position and the advanced position.

8. The connector assembly of claim 7, wherein a size, shape, position and material of the dielectric layers are selected to achieve a target impedance of the connector assembly at the intermediate position, the connector assembly achieving sub-optimal impedance when the mating contact and the terminating segment are mated at a position between the intermediate position and the retracted position and the connector assembly achieving sub-optimal impedance when the mating contact and the terminating segment are mated at a position between the intermediate position and the advanced position.

9. The connector assembly of claim 8, wherein the target impedance of the connector assembly is achieved when the connector assembly is only partially compressed.

10. A connector assembly, comprising:

a front shell and a rear shell slidably coupled to one another, the front shell and rear shell being compressed during mating with a mating connector between an extended position and a compressed position;

an insulator held by the front shell;

a center contact held by the insulator, the center contact having a terminating segment;

a mating contact held in the rear shell for mating with the terminating segment to form an electrical connection through the connector assembly, the mating contact and the terminating segment slidably engage one another, the mating contact and the terminating segment having a mating range defined between a refracted position and an advanced position corresponding to the extended position and the compressed position of the front shell and rear shell; and a compound dielectric surrounding the terminating segment, the compound dielectric positioned between the terminating segment and the shell, the compound dielectric comprising, a first dielectric layer at least partially surrounding the center contact; and a second dielectric layer at least partially surrounding the first dielectric layer;

wherein the second dielectric layer has a different dielectric constant than a dielectric constant of the first layer.

11. The connector assembly of claim 10, wherein the compound dielectric has a compound dielectric constant defined as an average dielectric constant of each of the layers of the compound dielectric between the shell and the terminating segment of the center contact.

12. The connector assembly of claim 11, wherein the compound dielectric constant is based on a thickness of the second dielectric layer.

13. The connector assembly of claim 11, wherein the thickness may be changed to change the compound dielectric constant.

14. The connector assembly of claim 10, the compound dielectric further including a third dielectric layer at least partially surrounding the second dielectric layer, the third dielectric layer having a dielectric constant different than the dielectric constant of the second dielectric layer.

15. The connector assembly of claim 10, wherein the first dielectric layer comprises air and the second dielectric layer comprises a plastic material.

16. The connector assembly of claim 10, wherein the dielectric layers are selected to achieve a target impedance of the connector assembly based on a target mating distance.

17. The connector assembly of claim 10, wherein the target impedance of the connector assembly is 50 ohms when the mating distance is in an intermediate zone.

18. The connector assembly of claim 10, wherein inductive and capacitive responses of an RF signal carried by the electrical connector assembly are reduced when the mating distance approaches an intermediate section of a mating range.

19. A connector assembly, comprising:

a shell having a front shell and a rear shell slidably coupled to one another as the connector assembly is compressed during mating with a mating connector, the front and rear shells being movable between an extended position and a compressed position;

an insulator held by the shell;

a center contact held by the insulator, the center contact having a terminating segment at an end thereof;

a mating contact held in the shell for mating with the terminating segment to form a center conductor through the connector assembly, the mating contact and the terminating segment slidably engage one another as the connector assembly is compressed, the mating contact and the terminating segment having a variable mating range defined between a retracted position and an advanced position corresponding to the extended position and the compressed position of the front and rear shells, the mating contact and the terminating segment being positionable at an intermediate position between the retracted position and the advanced position as the connector assembly is compressed; and a dielectric surrounding the at least a portion of the center conductor, the dielectric positioned between the center conductor and the shell, the dielectric being impedance matched with the shell and center conductor at the intermediate position as opposed to at the retracted position or at the advanced position.

20. The connector assembly of claim 19, wherein the mating contact and the terminating segment having a mating distance between the retracted position and the advanced position, the intermediate position being approximately half way along the mating distance between the retracted position and the advanced position.

* * * * *